United States Patent [19]

Olsson

[11] Patent Number: 4,653,825

[45] Date of Patent: Mar. 31, 1987

[54] SHIELDED ELECTRICAL CONNECTOR ASSEMBLY

[75] Inventor: Billy E. Olsson, New Cumberland, Pa.

[73] Assignee: AMP Incorporated, Harrisburg, Pa.

[21] Appl. No.: 773,730

[22] Filed: Sep. 6, 1985

[51] Int. Cl.[4] ..... H01R 13/648

[52] U.S. Cl. ..... 339/48; 29/861; 339/49 B; 339/102 R; 339/143 R; 339/206 R

[58] Field of Search ..... 339/143 R, 48, 49 R, 339/49 B, 102 R, 206 R, 210 R, 210 M, 212, 213, 97 P, 98, 99 R; 29/857, 861, 865, 866

[56] References Cited

U.S. PATENT DOCUMENTS

| | | | |
|---|---|---|---|
| 3,197,730 | 7/1965 | Hargett | 339/102 R |
| 3,335,388 | 8/1967 | Karol | 339/143 R |
| 3,671,921 | 6/1972 | Baker, III et al. | 339/206 R |
| 4,002,395 | 1/1977 | Wilson | 339/99 R |
| 4,255,009 | 3/1981 | Clark | 339/99 R |
| 4,449,778 | 5/1984 | Lane | 339/143 R |
| 4,501,459 | 2/1985 | Chaudler et al. | 339/48 |
| 4,514,029 | 4/1985 | Lax et al. | 339/143 R |

FOREIGN PATENT DOCUMENTS

| | | | |
|---|---|---|---|
| 125760 | 11/1984 | European Pat. Off. | 339/143 |

*Primary Examiner*—John McQuade
*Attorney, Agent, or Firm*—Robert W. Pitts

[57] ABSTRACT

A shielded hermaphroditic electrical connector and the method of assembling the connector is disclosed. The connector comprises an inner assembly to which both the individual conductors of a multiconductor cable are terminated by insulation displacement termination and to which the shielding surrounding the individual conductors in the cable is attached. The inner assembly includes a support housing, a plurality of terminals, a strain relief, and upper and lower shields which are all attached to a support housing by relative lateral movement. The shields are attached to the cable shielding by axial movement of the ferrule around a portion of the shields and a cover is assembled to the inner assembly and is subsequently post molded into engagement with the cable exterior. The connector can be hand assembled and is matable with other hermaphroditic local area network connectors of the same type.

20 Claims, 11 Drawing Figures

SHIELDED ELECTRICAL CONNECTOR ASSEMBLY

BACKGROUND OF THE INVENTION

1. Field of the Invention

This invention relates to electrical connectors for use in terminating shielded multiconductor cables and more specifically to shielded local area network electrical connectors and to the assembly of such connectors.

2. Description of the Prior Art

U.S. Pat. No. 4,501,459 discloses a local area network connector specifically intended for use in the data communications industry. These connectors can be employed in a closed loop data communications link in which various equipment such as computer terminals can be interconnected in a system. These connectors are specifically adapted for use in interconnecting numerous micro or mini computers in a computer network in an office environment. Connectors of this type have standard interface dimensions and configurations. These connectors must also be shielded to prevent spurious electrical signals and noise from affecting the signals in the network. These connectors also require a shunting capability since the conductors are part of a network and can be connected in series with other similar connectors. This shunting capability is necessary to prevent disruption of the network when an individual plug is not connected to external equipment.

The structure and components of local area network connectors of this type is represented by the structure of the connector shown in U.S. Pat. No. 4,501,459. These connectors include a plurality of spring metal terminals having insulation displacement wire barrels for establishing electrical connection with the individual conductors forming the multiconductor shielded cable. Terminals are positioned on a support housing and upper and lower shields can be positioned in surrounding relationship to the terminals and the support housing. These shields can be electrically commoned to the cable shielding by a ferrule and an insulative cover can be positioned in surrounding relationship to the connector assembly.

The insulation displacement termination of the connector shown in U.S. Pat. No. 4,501,459 employs a cylndrical barrel section for terminating the insulating conductors. The barrel extends upwardly on a terminal support surface and the terminals are inserted axially into an intermediate support housing. A stuffer comprising a combination strain relief and wire insertion member is first attached to the separate conductors and then mated with the barrel insulation displation terminals. Shield members are attached to upper and lower cover members and the cover members are mated to both encapsulate the conductor and to common the upper and lower shields to the cable shielding. A similar shielded electrical connector is disclosed in U.S. patent application Ser. No. 666,517 filed Oct. 30, 1984. This device employs a two-piece shield, the lower shield comprising a generally box-type configuration, whereas the upper shield is mounted in engagement with the sidewalls of the lower shield.

Each of these prior art local area network connectors provides an excellent interconnection for a shielded multiconductor cable in a local area network. Furthermore, each is adaptable to automated assembly. There exists however a need for a low cost local area network connector of this general type which can be easily hand assembled by an operator in a harness assembly plant. The instant invention fills that need for a relatively lower cost, hand assembled connector which would be suitable for use in a local area network in combination with prior art connectors of the type described herein.

SUMMARY OF THE INVENTION

The preferred embodiment of this invention comprises a hermaphroditic electrical connector for interconnecting a plurality of conductors in a multiconductor cable having cable shielding, surrounding the individual insulated conductors. The invention relates both to the structure of this electrical connector and especially to those structural elements which are significant in the assembly of the connector. The invention also relates to the method of assembling a connector of this type. The connector includes an inner subassembly and an outer subassembly. The inner subassembly includes a plurality of electrical terminals mounted on an insulative support housing with the conductors being secured to the support housing by a strain relief attached thereto. The inner assembly also includes upper and lower shields, each attachable to the inner support housing and a ferrule for electrically commoning the cable shielding to the shields. The various components of the inner assembly are assembled by lateral movement of the components relative to the support housing, and the insulative conductors are also interconnected to corresponding terminals by lateral movement of the conductors relative to their axis to form an insulation displacement termination with respective terminals. An outer subassembly comprises a hollow insulative housing partially surrounding the inner assembly and a post molded grommet securing the cover, and thus the inner assembly to the cable. In this manner both the individual conductors and the cable shielding may be electrically commoned during the fabrication of the connector. Fabrication of the connector is easily amenable to hand assembly, especially as part of a harness-making operation, since the components of the inner assembly essentially snap to a central support housing as a result of relative lateral movement.

The inner assembly, which is attached to the conductors and to the cable shielding as part of its assembly, can then be axially inserted into the cover, which is subsequently post molded to the exterior of the cable.

BRIEF DESCRIPTION OF THE DRAWINGS

FIG. 3 is a view of the attachment of the individual conductors to the terminals mounted in the insulated support housing.

FIG. 8 is a sectional view of the assembled connector.

FIG. 9 depicts the intermating of two hermaphroditic complementary connectors in accordance with the preferred embodiment of this invention.

DETAILED DESCRIPTION OF THE PREFERRED EMBODIMENT

Figure 1:
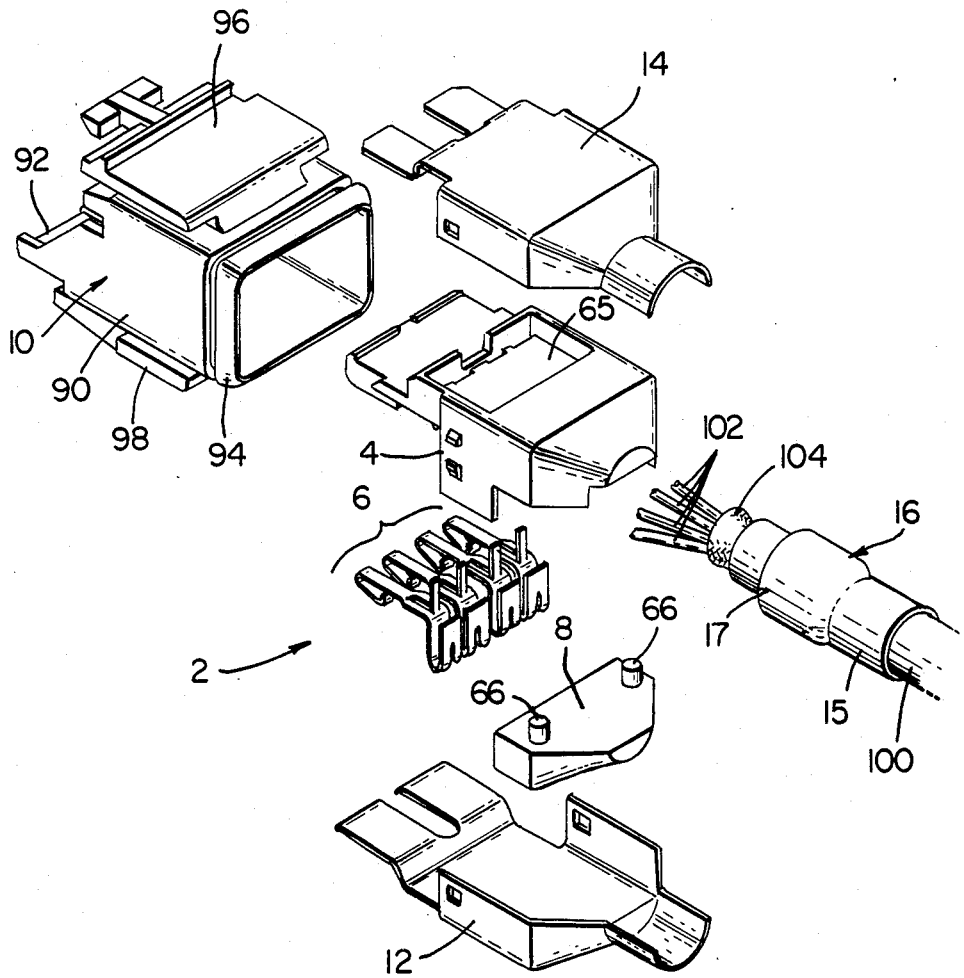
FIG. 1 is an exploded perspective showing the various individual components employed to fabricate the electrical connector comprising the preferred embodiment of this invention.

The local area connector 2 is a hermaphroditic electrical connector containing a plurality of components which can be assembled to establish electrical interconnection with a plurality of conductors 102 in a shielded cable 100. The connector includes an insulative support member 4 on which a plurality of terminals 6 can be positioned. A support block 8 is also attached to the support housing 4 to prevent damage to the conductors and terminals during the molding process of grommet 18. Upper and lower shields 12 and 14 are also attached to the support housing 4, after interconnection of the various conductors to the terminals 6. The support housing 4, the terminal 6, the support block 8, the upper and lower shields 12 and 14, and a ferrule 16, which is crimped to the cable 100 and used to electrically common the cable shielding to upper and lower shields 12 and 14, together comprise an inner assembly. This inner assembly can be inserted axially into an integrally molded insulative cover 10. A post molded grommet 18 engages both the insulative cover 10 and the cable, and extends around a portion of the inner assembly between the cover 10 and the cable to secure the connector to the end of the cable. The cover 10 and grommet 18 comprise an outer subassembly.

FIGS. 1 through 9 are intended not only to show the construction of the various components which together comprise local area network connector 2, but also show the various steps in the assembly of this connector. The orientation of the connector and the components in the various views shown herein has been chosen in order to illustrate the interrelationship between the various components and is not intended to represent the precise orientation of any component or components during any particular assembly step.

Figure 2A:
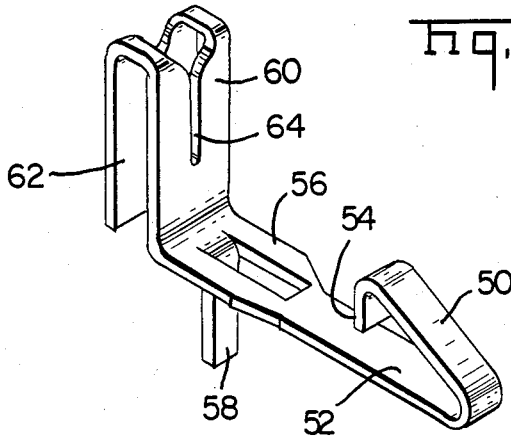
FIG. 2A is an enlarged view of a single electrical terminal.
Figure 2:
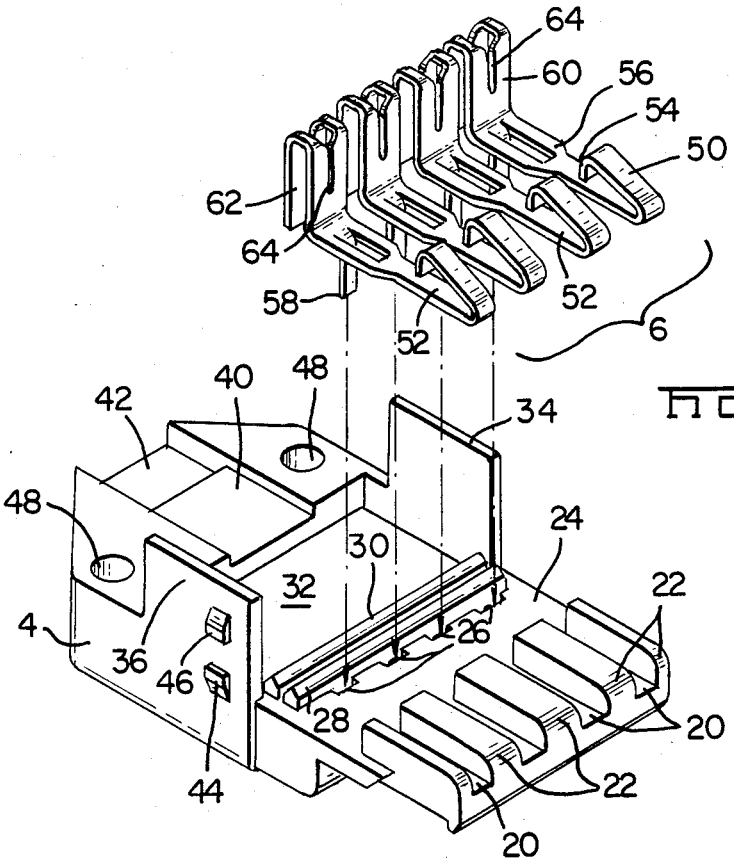
FIG. 2 is a perspective view demonstrating the assembly of a plurality of terminals to an insulated support housing.
Figure 7:
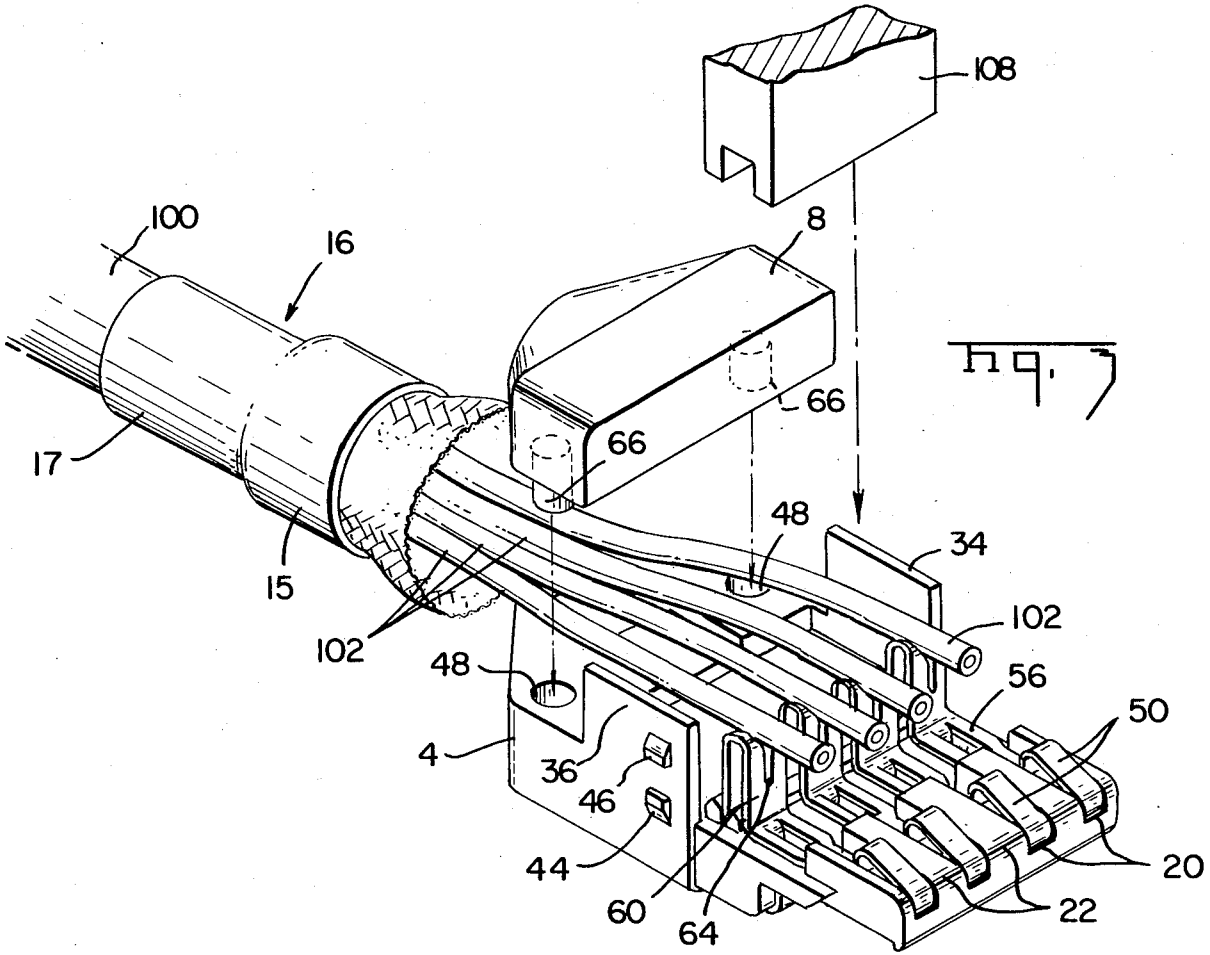
FIG. 7 depicts a post molded grommet added to secure the connector to the cable.

However, the assembly of the components will be described in terms of relative movement of the components in three different directions, an axial direction, a transverse direction and a lateral direction. The axial direction will be understood to generally be along the axis of a cable extending directly into the rear of the connector assembly. The transverse direction will extend generally perpendicular to the axial direction. The faces 24, 32, and 40 of the support housing 4 as shown in FIG. 2 will extend in the transverse direction. The transverse direction will be generally perpendicular to the direction of movement of conductors 102 during insertion of the conductors into the insulation displacement slots 64 in the terminals 6. The direction of movement of the conductors 102 during termination into the insulation displacement slots 64 will be considered the lateral direction and will be generally mutually perpendicular to the axial direction and to the transverse direction.

The first step in the assembly of the hermaphroditic local area network connector 2 is the assembly of a plurality of terminals 6 on an insulative support member 4. The assembly steps and the structure of the terminals and the support housing are shown in FIGS. 2 and 2A. The support member 4 has a front or mating end along which a plurality of open ended channels 20 separated and defined by upstanding ribs 22 and a rear or cable entry end having a cable receiving groove 42. A generally transversely extending side of the support housing 4, on which the open ended channels are located includes a front terminal support face 24, an intermediate and generally coplanar conductor support face 32 located generally to the rear of the front terminal support face 24 and a conductor support face 40 extending rearwardly from intermediate conductor support face 32. Note that the rear cable support face 40 is not coplanar with the lower face 32. A plurality of transversely side-by-side apertures 26 is located generally at the intersection of the terminal support face 24 and the conductor support face 32. Two side-by-side ridges 28 and 30, also extending transversely, are located adjacent the apertures 26 and also are located at the juncture between the terminal support face 24 and the lower face 32. The apertures 26 extend from the side of the support member 4 shown in FIG. 2 to the opposite side of the support member shown in FIG. 1. These apertures 26 are adapted to receive laterally extending terminal shunt bars 58 on terminals 6. These terminal shunt bars extend through the apertures 26 into a shunt cavity 65. A shunting bar assembly such as that shown in U.S. patent application Ser. No. 684,233 filed on Dec. 20, 1984 can be positioned within the cavity 65. This previously filed and copending patent application is incorporated herein by reference. The apertures 26 and the ridges 28 and 30 comprise means for positioning the terminals on the support housing 4.

The support housing 4 includes a pair of generally planar opposed walls 34 and 36 extending upwardly from the sides of the housing member and extending above the transversely extending conductor support face 32. These walls 34 and 36 extend laterally relative to the support housing 4. A pair of fastener members 44 and 46 are located on the outer surface of each of the opposed sidewalls 34 and 36. Each fastener member comprises a projection in the form of a locking member which has a ramp surface and a generally perpendicular locking surface on the opposite side of the projection. Thus these fastener projections 44 will cam a mating member outwardly upon relative lateral movement. Upon sufficient lateral movement, the laterally moving member will snap in to engage the perpendicular surface of the fastener projectors to prevent withdrawal and to secure the laterally moving component, such as shields 12 and 14 to the support housing 4. The fastener members 44 and 46 on each side of the support housing are oppositely directed so that both the upper and lower shields 12 and 14 can be secured to the housing and their mating or butt line would extend between the oppositely facing fastener members 44 and 46. The cable receiving surface 40 extends generally rearwardly of the opposed walls 34 and 36 and a pair of mounting holes 48 extends inwardly into the support housing on opposite sides of surface 40. These holes 48 flank a central cable receiving trough 42 located on the rear end of the support housing 4. Support housing 4 is integrally molded of an insulative material such as a conventional plastic. Various high performance plastics might also be used if required.

A plurality of stamped and formed terminals can be positioned in side by side arrangement with the terminals extending into the open ended channels 22 on the support housing 4. These terminals are stamped and formed from a conventonal spring metal and a structure of an individual terminal 6 is shown more clearly in FIG. 2A. Each terminal includes a conductor termination element and a contact spring element located on opposite ends of the terminals. The contact spring element comprises a reversely formed spring consisting of a obliquely extending contact face section 50 joined by reverse bend to an axially extending base section 52. The free end of the contact spring section is formed in the lateral direction to provide an anti-overstress extension 54, which will engage the base portion 52 to prevent overdeflection of the contact surface 50. The base section 52 fits within the open-ended channels 20 of the support housing 4 with the oblique contact surface sections 50 extending upwardly above the ribs 22, in position to mate with the terminals in a complementary connector.

A central terminal section 56 extends rearwardly of the ribs 22 and lies along the terminal support face 24 of support housing 4. A shunt extension bar 58 is formed downwardly from the central section 56 in position to extend through the apertures 26.

The conductor termination element comprises a reversely formed insulation displacement member comprising two parallel plates 60 and 62, joined by an intermediate bight and having a common slot 64 extending into and through both plate sections 60 and 62 and the intermediate bight. The insulation displacement slot is stamped from the terminal prior to forming, and when the plate section 60 and 62 are reversely formed the slot forms two branches to separately contact an individual conductor at two axial locations. Thus the slot can receive a conductor inserted laterally of the axis of the conductor and in a lateral direction relative to the terminal 2. FIG. 2 shows that a plurality of terminals 6 can be simultaneously or individually inserted in a lateral direction and assembled to the support housing 4. The shunt bar extensions 58 extend through apertures 26, and the free end of plate section 62 is received between the ridges 28 and 30, which thus serve to position the terminal on the support member 4. As previously described, the base section 52 of the contact spring element is received within the open-ended channels 20 at the front of the support member 4.

With the terminal 6 assembled to the support housing 4, individual conductors 102 in a multiconductor cable 100 can then be inserted into corresponding terminals to form an insulation displation electrical contact simply by movement of the conductors laterally of their axis into the insulation displacement slot. This conductor termination step is shown in FIG. 3. A cable 100 having a ferrule 16 previously inserted around the exterior of the cable and having the cable shielding 104, which can consist of a conventional braid or a conductive foil displayed for subsequent grounding, is presented to the support member with the conductors extending along the conductor support surface 40, the lower surface 32, and in alignment with the insulation displacement slots 64 of the terminals. A conventional inserter 108 can now be positioned in registry with conductors 102 and with the conductor termination section of terminals 6 to urge the conductors laterally of their axis into the insulation displacement slots 64. The insulation surrounding the conductive core is penetrated or displaced such that the edges of slot 64 engage the conductive core to form an electrical interconnection with the various conductors. Although simultaneous insertion of each of the conductors into insulation displacement slots 64 is illustrated in FIG. 3, it should be understood that the conductors can be individually inserted into corresponding insulation displacement slots.

Figure 4:
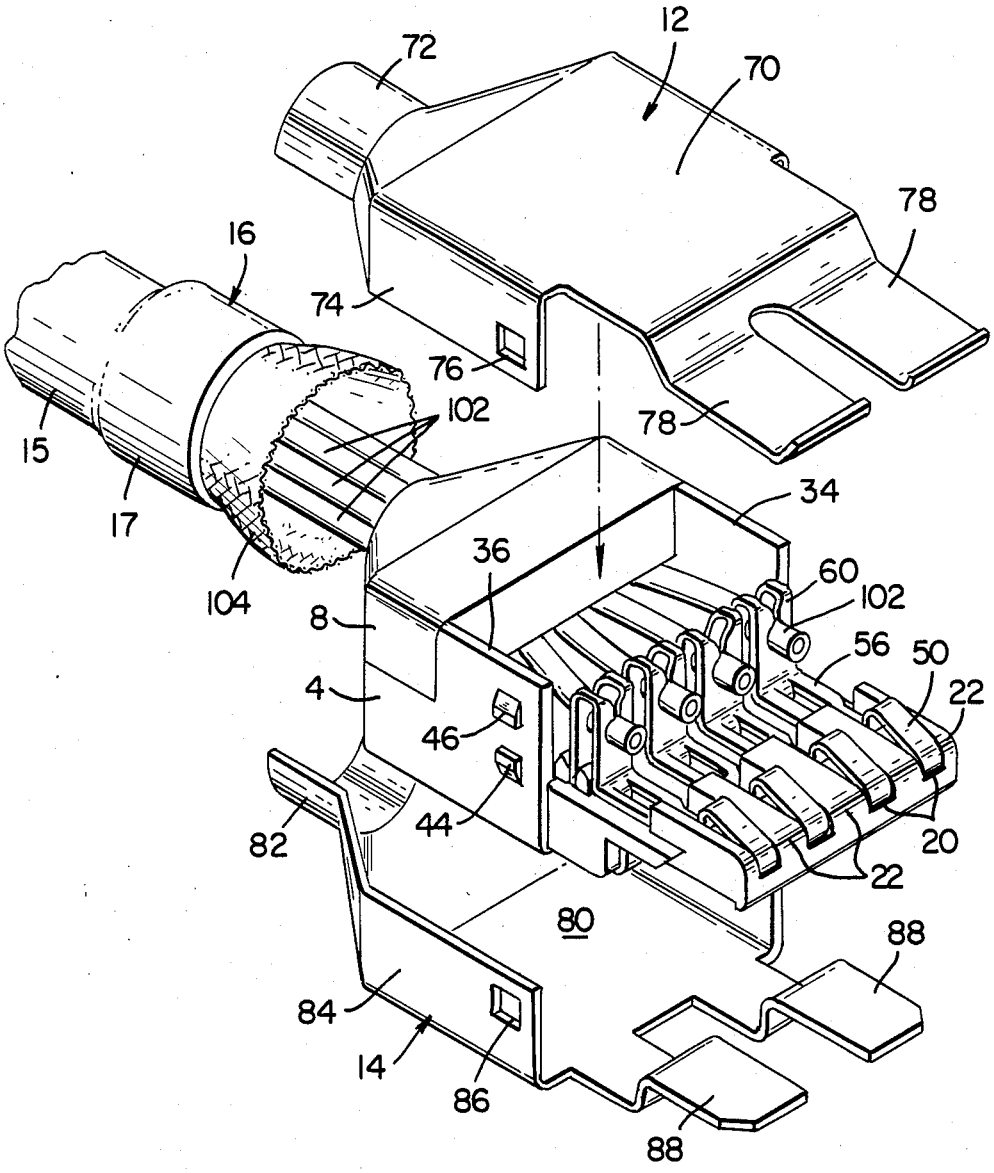
FIG. 4 is a view of the assembly of the upper and lower shields in the inner assembly.

After the conductors 102 have been interconnected to the terminals 6, with the terminal 6 and the support block 8 secured to the support body 4, by the insertion of projections 66 into apertures 48 the upper and lower shields 12 and 14 can now be assembled to support housing 4. The configuration of the upper and lower shields 12 and 14 and their assembly to the support housing 4 is depicted in FIG. 4. The upper shield 12 is formed of a conductive metal and has a central base section 70 from which several extensions are formed. A semicircular cable shielding extension 72 extends from the rear of the shield. Laterally extending flanges 74 extend from opposite sides of the base section 70. These flanges 74 are transversely flexible and each has a notch 76 defined therein. Two flexible shield contact tongues 78 extend from the front section of the base 70. The lower shield 14 similarly has a central base 80, a cable shielding extension 82, flanges 84, notches 86, and two contact tongues 88 at the forward end. Since each shield is adapted to be mated to opposite surfaces of the central connector 4 the configuration of the upper shield 12 need not be precisely the same as the lower shield 14. Both the upper and lower shields 12 and 14 can now be moved laterally relative to the support body 4. As the shields are moved laterally, the flanges 74 and 84 flex outwardly to permit movement past fastener projections 44 and 46. When assembled to support member 4, the semicircular extensions 72 and 82 extend around the conductors 102, underneath the shielding braid 104, and beyond the rear of the support housing 4.

Figure 5:
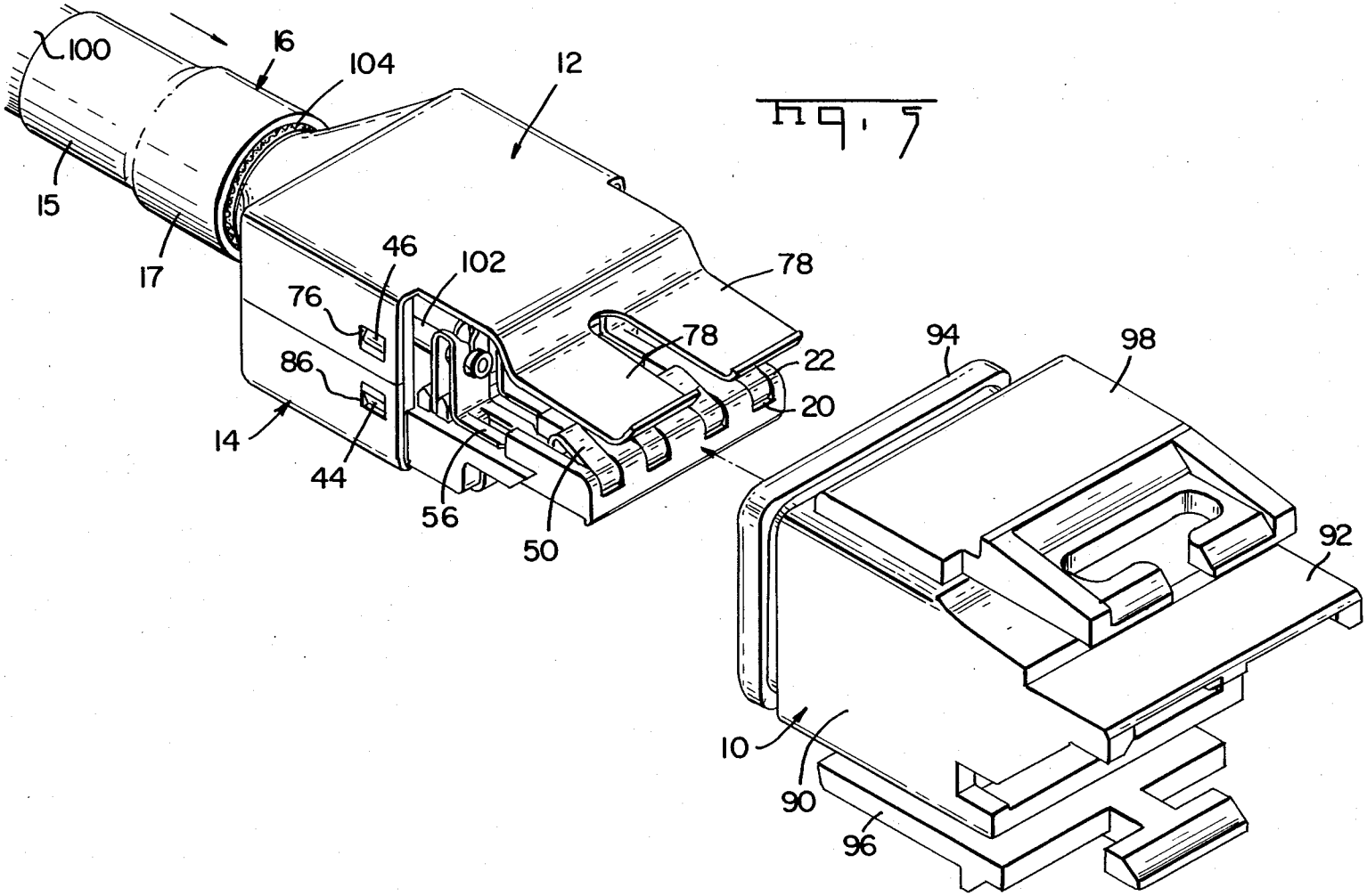
FIG. 5 depicts the axial insertion of the inner assembly into an outer cover member.

FIG. 5 demonstrates the completion of an inner subassembly in which a portion of the connector is connected directly to the end of the cable 100. After the shields 12 and 14 have been assembled to support member 4, the ferrule 16 can be shifted axially to entrap the cable shielding 104 between the large diameter portion 17 of the ferrule 16 and the shield extensions 72 and 82. The small diameter portion 15 of ferrule 16 is then crimped to the cable 100. This inner assembly comprises the support housing 4, the terminals 6, the support block 8, the upper and lower shields 12 and 14, and the ferrule 16, all of which are now secured to the cable 100 with the conductors 102 in contact with corresponding terminals 6 and with the upper and lower shields electrically common to the cable shielding 104. This inner subassembly comprising these various inner components can now be at least partially inserted into an outer insulative cover 10. The insulative cover 10 comprises an integrally molded body formed of a conventional plastic material through which the inner subassembly can be at least partially inserted. The integrally molded body 90 is hollow but completely encircles that portion of the inner subassembly inserted therein. The cover 10 includes a transversely extending hood 92 located above the terminal contact sections 50 when positioned within the channels 22. The shield contact tongues 78 on the upper shield 12 extend between the hood 92 and the terminal contact section 50 of the terminal 6 in the support housing 4. Cover 10 also has a pair of integrally molded latching members 96 and 98 adapted to engage corresponding latching members on a complementary hermaphroditic electrical connector or on another suitable mateable electrical connector. The latching configuration of latching members 96 and 98 is conventional.

Insulated cover 10 also has a retention rib 94 molded at the rear of the cover for engagement with a post molded grommet as will be described subsequently. The inner subassembly can be axially inserted into the outer cover 10 to position the contact terminals adjacent the front edge and below the hood 92. The insulative cover will completely encircle that portion of the inner subassembly inserted therein and will encompass at least a portion of the axial extent of the inner subassembly. Note that the ferrule 16 and the rear portion of the cable shields 12 and 14 will extend beyond the axial extent of the insulative cover 10.

Figure 6:
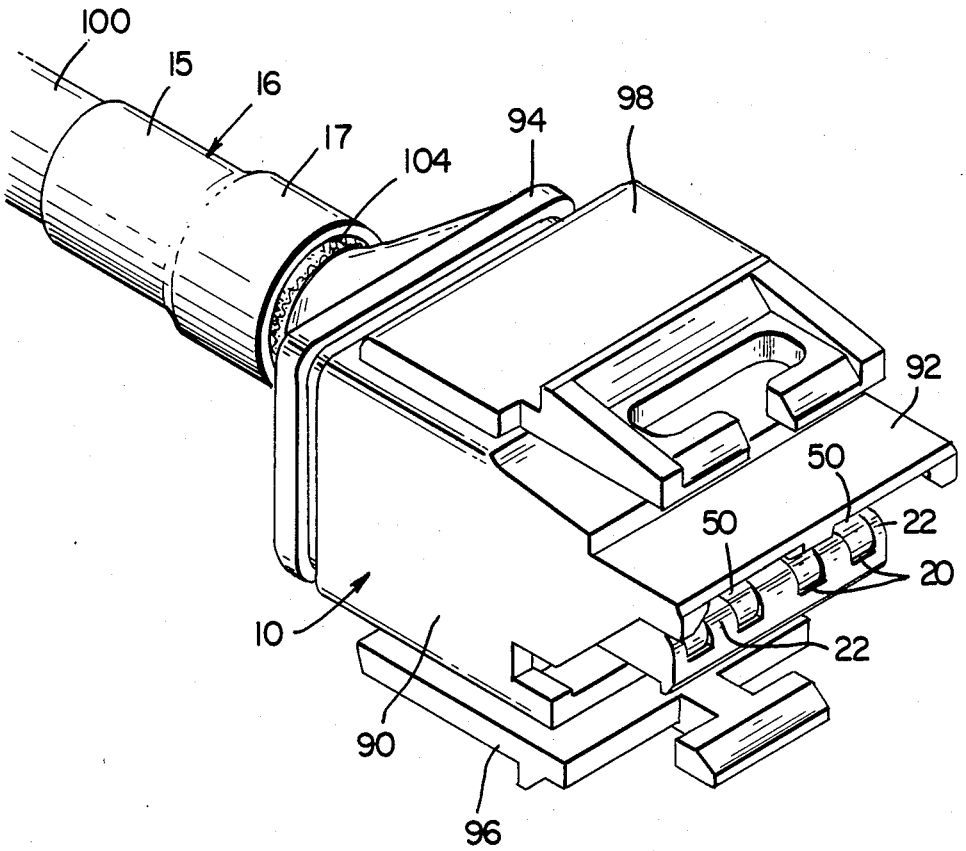
FIG. 6 depicts the outer cover member in a similar configuration relative to the inner assembly.
Figure 7:
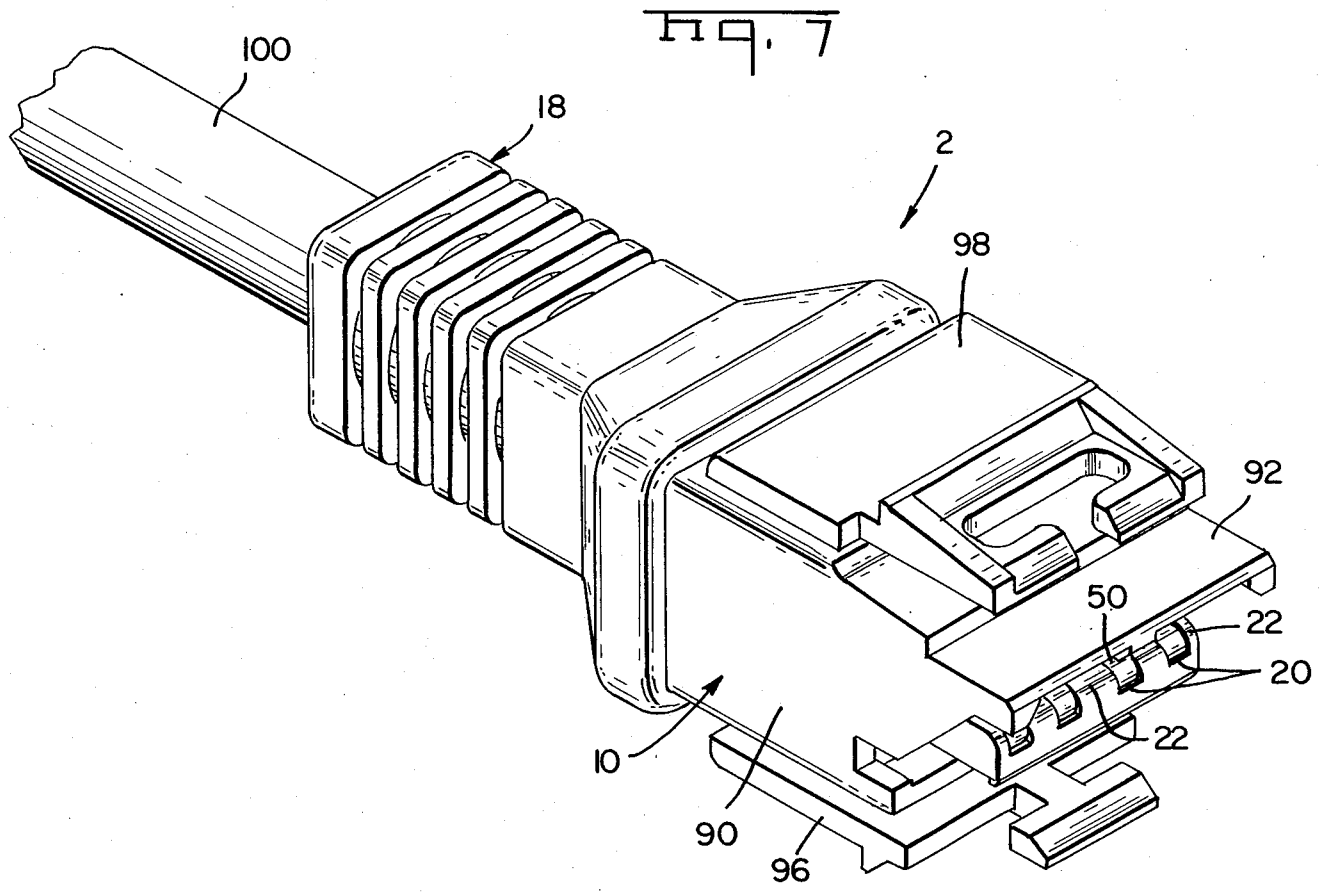
Figure 6:
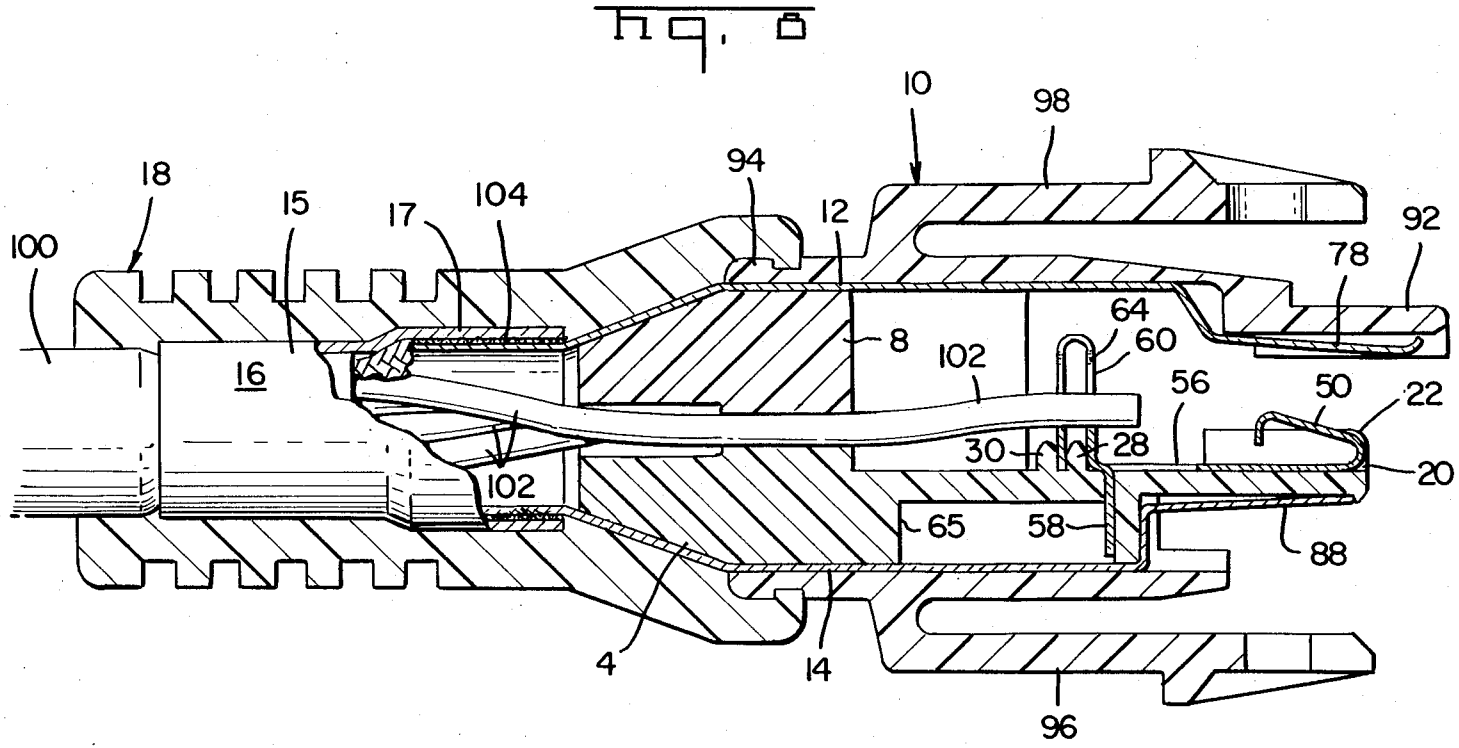
Figure 7:
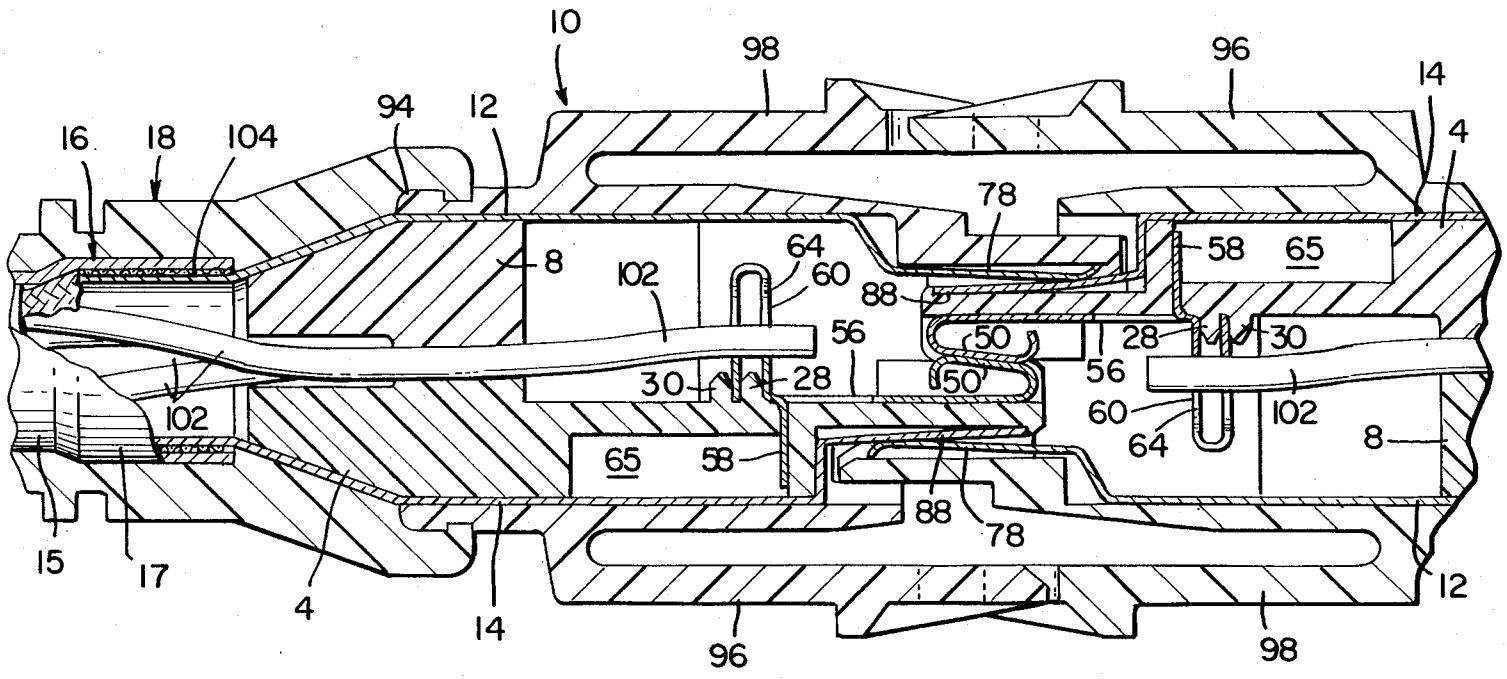

FIG. 6 shows the insulative cover 10 with the inner subassembly 2 inserted therein. In the configuration shown in FIG. 7, the cover 10 and the connector itself can be securely attached to the cable 100 by a post molding operation in which a flexible grommet 18 is molded around the rib 94 of the cover 10 and around the cable end. Ferrule 16 and the rear portion of the cable shields will be contained within the post molded grommet 18.

FIG. 8 illustrates the configuration of the connector 2 in its final assembly. Note that ferrule 16 and grommet 18 act in conjunction as strain relief members, preventing a tensile force on cable 100 from being transmitted to the conductors 102 and terminal slot 64. Any tension on cable 100 will be transmitted directly to ferrule 16, because ferrule 16 is crimped to cable 100. The tension will in turn be transmitted to the grommet 18, as the grommet 18 is molded over both the ferrule large and small diameter portions 17 and 15, respectively. Finally, the tensile force is transmitted to the cover, as grommet 18 is molded over the retention ribs 94 of cover 10.

FIG. 8 also shows the function of support block 8 during the molding process. Large forces are applied to the cable 100, ferrule 16 and housing 10 during the molding process. Support block 8 protects the conductors 102 from the large forces transmitted to the housing 10 at the intersection of the grommet 18 and the retention ribs 94.

FIG. 9 shows the interconnection of two such hermaphroditic local area network connectors interconnected with two complementary connectors positioned such that complementary terminals are in engagement. Note that the cover hoods 92 on each connector engages the lower surface of the support housing 4. Shield tongues 78 and 88 are in engagement and provide complete and continuous shielding of conductors 102 and terminals 6. Terminal contact surfaces on complementary connectors are deflected and form an electrical interconnection between corresponding terminals and between corresponding conductors 102. Note, the insulative cover 10 and the post molded grommet thus form an outer subassembly entirely encircling the inner subassembly.

Figure 10:
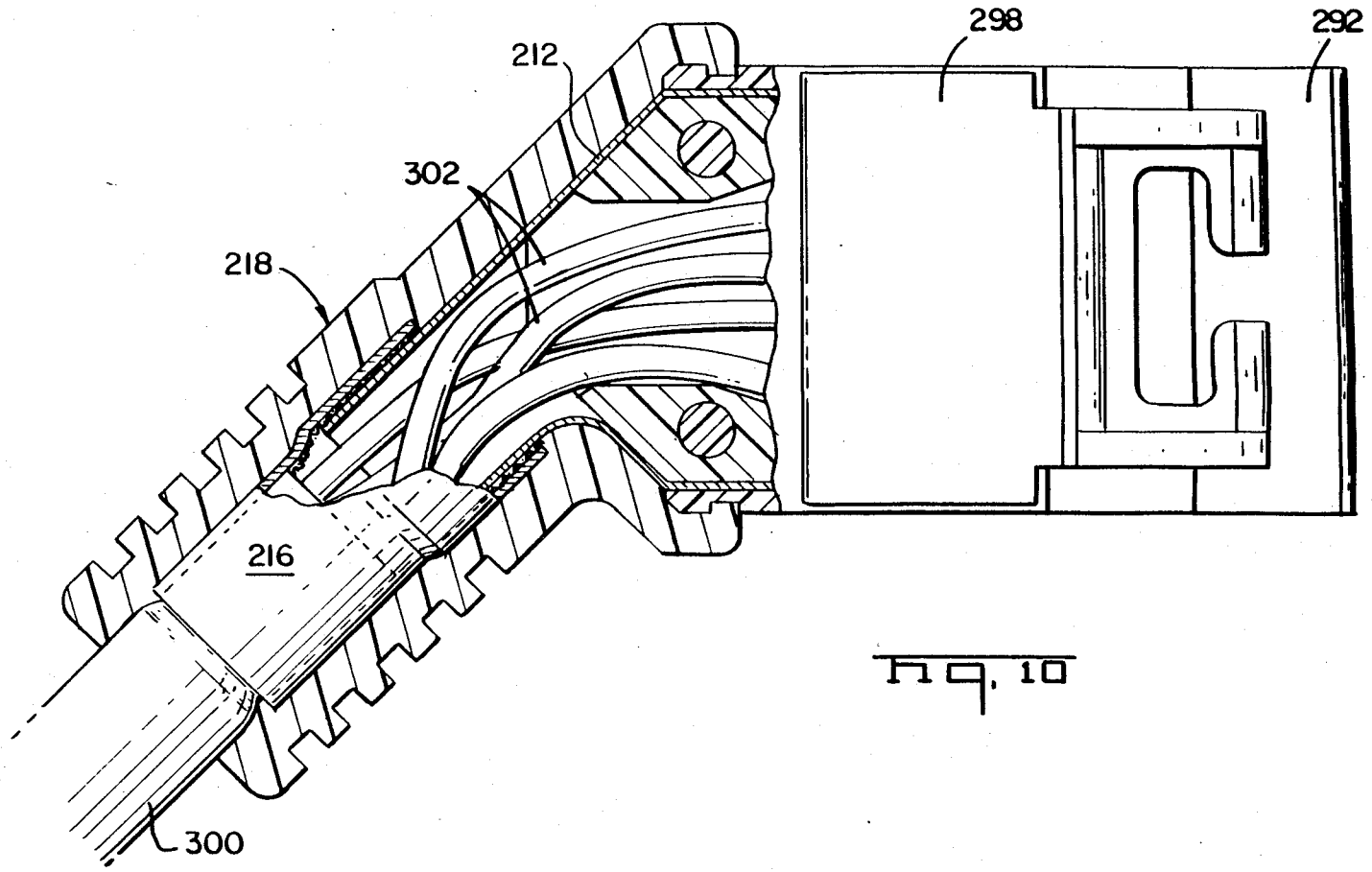
FIG. 10 is a side view, partially in section, of an alternate embodiment in which the cable is offset.

FIG. 10 shows an alternate embodiment of the present invention. Numerals 212, 216, 218, 292, 298, 300 and 302 refer to corresponding structures numbered 12, 16, 18, 92, 98, 100 and 102 for the preferred embodiment. Shield members 212 and a mating shield member (not shown) are formed at offset angles with respect to the axial direction, such that cable 300 is offset to the left or to the right, as required.

The connector described herein together with its method of assembly are especially adapted for hand assembly to a shielded multiconductor cable. It should be understood however that semiautomatic or automatic assembly of the various components of the connector to a multiconductor cable might also be employed. The only step not directly amenable to hand assembly is the post molding of the grommet between the cover and the cable. That post molding step does not however prevent this connector from being easily and inexpensively assembled to a cable in the manner described herein. The embodiment depicted herein is one preferred method of implementing the invention in the following claims, but it should be understood that other embodiments varying in detail would be readily apparent to one skilled in the art in light of the disclosure set forth herein and that the appended claim should not be limited to the single embodiment depicted herein.

I claim:

1. A hermaphroditic local area network connector for interconnecting a plurality of conductors in a multiconductor cable having cable shielding encompassing the conductors, the connector comprising:

a plurality of terminals, each formed of a spring metal and having a conductor termination element and a contact spring element;

an insulative support housing having a transversely and axially extending terminal support face, the terminal support face including a plurality of axial side-by-side open ended channels, a portion of each terminal being positioned in a corresponding channel;

upper and lower mutually engagable shields at least partially surrounding the terminals and the support housing, the upper and lower shields being snap fastened to the support housing;

a ferrule engaging the cable shielding and comprising means for electrically commoning the cable shielding to the shields;

insulative cover means including connector latching members; wherein the terminals and the upper and lower shields are each attachable to the support housing to form an inner subassembly attached to the conductors, the inner subassembly being at least partially insertable into the insulative cover means, the insulative cover means comprising an integrally molded member encircling and at least partially encompassing the inner subassembly.

2. The connector of claim 1 further comprising a post molded grommet engaging the cable and the cover means retaining the connector on the end of the cable.

3. The connector of claim 2 wherein the terminals and the upper and lower shields are each securable to the terminal support housing by movement thereof laterally relative to the support housing and lateral of the axis of the conductors.

4. The connector of claim 3 wherein the terminal support housing includes opposed walls, each wall having a pair of oppositely facing fastener members, the upper and lower shields being attached to the terminal support housing by the fastener members.

5. The connector of claim 4 wherein the insulative cover means includes a transversely extending hood, the hood extending over the terminal contact spring elements and the open ended channels.

6. The connector of claim 5 wherein the shields each include at least one shield contact tongue, the tongue on one shield extending between the hood and the terminal contact spring elements.

7. The connector of claim 6 wherein the cover hood engages the support housing of the complementary connector upon mating two hermaphroditic connectors.

8. A hermaphroditic electrical connector for interconnecting a plurality of conductors in a multiconductor cable having cable shielding encompassing the conductors, the connector comprising:

an inner subassembly comprising a plurality of inner components including;

a plurality of terminals, each formed of a spring metal and having a conductor termination element and a contact spring element;

an insulative support housing having a transversely and axially extending front terminal support face and a coplanar conductor support face, the terminal support face having a plurality of axial side-by-side open ended channels and terminal positioning means for positioning the terminals upon assembly of the terminals laterally to the terminal support face, the terminal contact spring element being received within the open ended channels upon lateral movement thereof, the support housing also having opposed walls extending upwardly from the conductor support face, each wall having a pair of oppositely facing fastener members on the outer surface thereof;

upper and lower electrical shields, each attachable to the support housing, each electrical shield engaging fastener members on the support housing walls for retention thereon, each shield having a cable shielding extension; and an outer subassembly comprising an insulative cover and a ferrule, wherein;

the insulative cover being integrally molded and encircling and at least partially encompassing the inner subassembly; the inner subassembly being axially insertable into the insulative cover;

the ferrule encircling the cable, the cable shielding extensions being axially insertable into the ferrule, the ferrule and the cable shielding extensions together comprising means for electrically commoning the cable shielding to the upper and lower shields; the connector further comprising;

a post molded grommet attaching the cover to the cable to secure the connector to the cable, whereby the inner subassembly is first assembled and attached to the conductors by relative lateral movements of the inner components and the conductors and subsequently axially assembled to the outer subassembly, and the connector is post molded to the cable.

9. The connector of claim 8 wherein each terminal comprises a stamped and formed plate and the conductor termination element comprises a slot stamped in the plate to define an insulation displacement electrical interconnection upon insertion of a conductor laterally of its axis into the slot.

10. The connector of claim 9 wherein the conductor termination element comprises two reversely formed plate sections, one plate section having a free end received within the terminal positioning means.

11. The connector of claim 10 wherein the terminal positioning means comprises a pair of transversely extending axially spaced ridges on the terminal support face.

12. The connector of claim 8 wherein each terminal contact spring element comprises a reversely formed spring laterally deflectable upon axial engagement with an identical terminal.

13. The connector of claim 12 wherein the cover includes a transversely extending hood extending over the terminal contact spring elements.

14. The connector of claim 13 wherein each upper shield includes at least one shield contact tongue extending between the cover hood and the terminal contact spring elements, each tongue comprising means for contacting a complementary shield on a mating connector.

15. The connector of claim 8 comprising a support means covering and protecting the conductors during the grommet molding process.

16. The connector of claim 13 wherein the cover hood engages the support housing of a complementary connector upon mating two hermaphroditic connectors.

17. A method of assembling a hermaphroditic local area network electrical connector to a plurality of conductors in a multiconductor cable and to cable shielding encompassing the conductors in the cable, the method comprising the steps of:

assembling a plurality of electrical terminals on a surface of an insulative support housing;

positioning the conductors adjacent the surface on the support housing and covering the exposed conductors by attaching a support means to the support housing;

inserting the conductors laterally of their axes into insulation displacement contact with respective terminals;

snap fastening upper and lower conductive shields to the support housing in surrounding relationship to the terminals and the support housing;

electrically commoning the shields to the cable shielding;

axially inserting the components previously attached to the support member at least partially into an integrally molded member encircling the support member and the components attached thereto; and post molding a grommet on the exterior in engagement with the integrally molded member and the cable to attach the connector to the end of the cable.

18. The method of claim 17 including the further step of inserting a ferrule around the end of the cable before attachment of the conductors to the terminals.

19. The method of claim 18 comprising the further step of securing the cable shielding between the ferrule and the shields after the shields are attached to the support housing.

20. A hermaphroditic local area network connector for interconnecting a plurality of conductors in a multiconductor cable having cable shielding encompassing the conductors, the connector comprising:

a plurality of terminals, each formed of a spring metal and having a conductor termination element and a contact spring element;

an insulative support housing having a transversely and axially extending terminal support face, the terminal support face including a plurality of axial side-by-side open ended channels, a portion of each terminal being positioned in a corresponding channel;

upper and lower mutually engagable shields at least partially surrounding the terminals and the support housing, the upper and lower shields being snap fastened to the support housing;

a ferrule engaging the cable shielding and comprising means for electrically commoning the cable shielding to the shields;

insulative cover means including connector latching members; wherein the terminals and the upper and lower shields are each attached to the support housing to form an inner subassembly attachable at a rearward end to the conductors and matable at a forward end with another hermaphroditic local area network connector, the inner subassembly being at least partially insertable into the insulative cover means, the insulative cover means comprising an integrally molded member encircling and at least partially encompassing the forward portion of the inner subassembly.

* * * * *